US008827385B2

(12) United States Patent
James et al.

(10) Patent No.: US 8,827,385 B2
(45) Date of Patent: Sep. 9, 2014

(54) CABINET SHELF SECURING MEMBERS

(75) Inventors: Gary W. James, Parma Heights, OH (US); Bernard J. Golias, Jr., Twinsburg, OH (US); Robert J. Golias, Solon, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 1081 days.

(21) Appl. No.: 10/812,148

(22) Filed: Mar. 29, 2004

(65) Prior Publication Data

US 2004/0189159 A1 Sep. 30, 2004

Related U.S. Application Data

(60) Provisional application No. 60/458,810, filed on Mar. 28, 2003.

(51) Int. Cl.
*A47B 43/00* (2006.01)
*A47B 57/16* (2006.01)

(52) U.S. Cl.
CPC ..... *A47B 57/16* (2013.01)
USPC ..... 312/257.1

(58) Field of Classification Search
USPC ..... 312/224, 227, 257.1, 242, 245, 351; 108/106, 107, 110, 147.11; 248/247, 248/248, 250, 222.11, 222.13; 211/186, 211/187; 403/397, 239
See application file for complete search history.

(56) References Cited

U.S. PATENT DOCUMENTS

| | | | | | |
|---|---|---|---|---|---|
| 1,164,439 | A | * | 12/1915 | Winquist | 108/110 |
| 1,941,126 | A | * | 12/1933 | Blackman | 312/329 |
| 2,911,275 | A | * | 11/1959 | Wise | 312/242 |
| 3,168,365 | A | * | 2/1965 | Evans | 312/351 |
| 3,422,775 | A | * | 1/1969 | Johnsson | 108/109 |
| 3,677,202 | A | * | 7/1972 | Young | 108/109 |
| 4,013,253 | A | * | 3/1977 | Perrault et al. | 248/222.51 |
| 4,034,683 | A | * | 7/1977 | DiCenzo | 108/107 |
| 4,101,108 | A | * | 7/1978 | Klein | 248/243 |
| 4,142,638 | A | * | 3/1979 | Vargo | 211/187 |
| 4,189,796 | A | * | 2/1980 | Gutner | 5/8 |
| 4,201,139 | A | * | 5/1980 | Suttles | 108/109 |
| 4,269,318 | A | * | 5/1981 | Levitt et al. | 211/153 |
| 4,288,132 | A | * | 9/1981 | Znamirowski et al. | 312/265.5 |
| 4,553,725 | A | * | 11/1985 | Vargo | 248/221.11 |
| 5,267,383 | A | | 12/1993 | Sawdon | |
| 5,329,835 | A | | 7/1994 | Timp et al. | |
| 5,737,819 | A | | 4/1998 | Sawdon et al. | |
| 6,152,552 | A | * | 11/2000 | Snoke et al. | 312/257.1 |

OTHER PUBLICATIONS

Punch Press, Zip-Tech®: New Fastening Technology From Wilson Tool, Mar./Apr. 2001.
Product Bulletin, Zip-Tech™: Fastening Technology for the Future, vol. 4, No. 1.

* cited by examiner

*Primary Examiner* — Matthew Ing
(74) *Attorney, Agent, or Firm* — James E. Scarbrough; Fay Sharpe LLP

(57) ABSTRACT

A metal cabinet includes a side wall and a support member extending from the side wall. The support member includes a first leg extending at least substantially normal to the side wall and the second leg extending from the first leg spaced from and at least substantially parallel to the side wall. The second leg includes a protrusion to provide a friction fit between a selectively removable shelf and the support member.

4 Claims, 8 Drawing Sheets

CABINET SHELF SECURING MEMBERS

This application claims the benefit of U.S. Provisional Application No. 60/458,810, filed Mar. 28, 2003, which is incorporated by reference herein.

BACKGROUND OF THE INVENTION

The present invention relates generally to support members used to secure a removable shelf to internal walls of a metal cabinet. More particularly, the invention relates to an improved support member or lance having a dimple to allow a metal shelf to mount more securely to a side wall in a metal cabinet.

Metal cabinets are some of the most versatile pieces of furniture available. Metal cabinets can be hung in work areas such as metal or woodworking shops, garages, as well as many other places. Metal cabinets can also provide storage in vehicles such as trucks and vans. In addition to the versatility provided by metal cabinets regarding the location and placement of the cabinets, metal cabinets also provide versatility in what they store. Metal cabinets have been used to store threaded rod, wire, brake line, welding rods, as well as more common items such as tools and fasteners. To increase a metal cabinet's versatility, some of the shelves are removable so that larger or different items can be stored in the cabinet.

Removable shelves are mounted to internal side walls of the cabinet. Typically, lances are punched in the side walls of the cabinet to provide a retaining member in which a portion of a removable shelf can be placed to mount the shelf. Typically, the shelf can be easily removed from the lance by lifting up vertically on the shelf. Furthermore, nothing prevents the shelf from moving out of engagement with the lance. Thus, it would be desirable to provide a device that would promote a friction fit between the lance and the shelf so that removal of the shelf is still possible; however, the shelf has a tighter fit to the side wall and is more securely held in place.

SUMMARY OF THE INVENTION

A metal cabinet includes a side wall and a support member or lance extending from the side wall. The support member includes a first leg extending at least substantially normal to the side wall and the second leg extending from the first leg spaced from and at least substantially parallel to the side wall. The second leg includes a protrusion or dimple.

A method of installing a removable shelf in a cabinet including side walls having lances formed therein, wherein each of the lances includes a dimple formed in a leg that is substantially parallel to the respective side wall from which the lance is formed includes the following: providing a shelf having a plurality of flanges depending from a planar surface, wherein the flanges include openings that align with the dimples of the lances, and placing the flanges of the shelf in the lances such that the openings in the flanges receive the dimples on the lances.

Still other aspects of the invention will become apparent to those skilled in the art upon reading and understanding the following detailed description.

BRIEF DESCRIPTION OF THE DRAWINGS

The invention takes form in certain parts and arrangements of parts, preferred embodiments of which will be described in detail in this specification and illustrated in the accompanying drawings which form a part hereof and wherein.

DETAILED DESCRIPTION OF THE EMBODIMENTS

Figure 1:
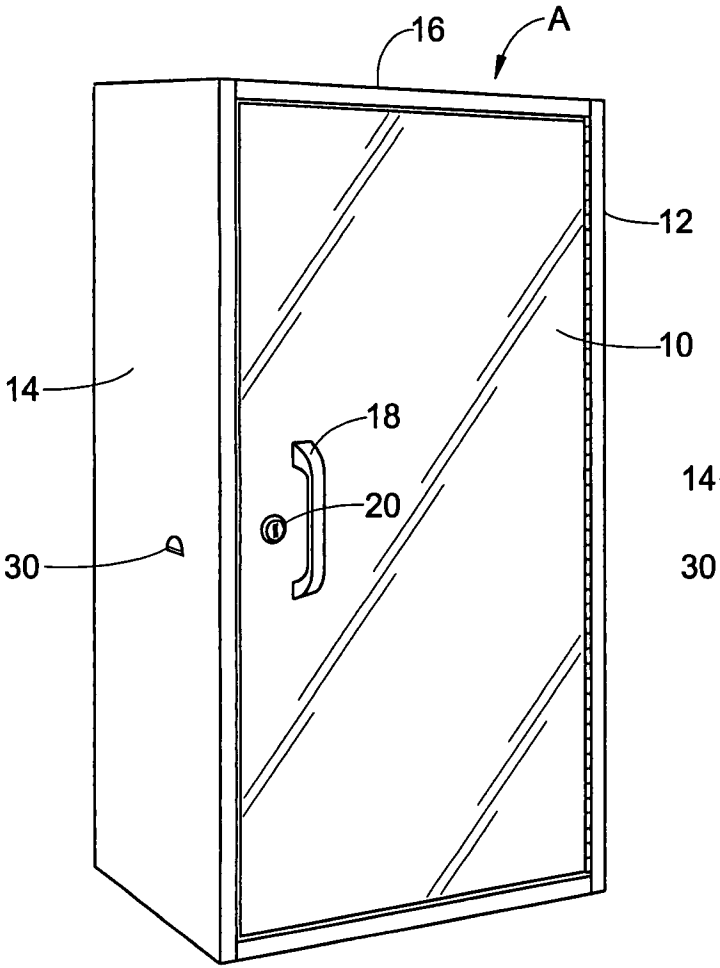

Referring now to the figures, wherein the showings are for purposes of illustrating the preferred embodiments of the invention only and are not for purposes of limiting same, FIG. 1 shows a metal cabinet A having a door 10, side walls 12 and 14, and a top wall 16. The door is hingedly attached to the side wall 12 and includes a handle 18 and a lock 20. Openings 30 are formed when support members or lances 32 are formed or punched in side walls 12 and 14.

Figure 2:
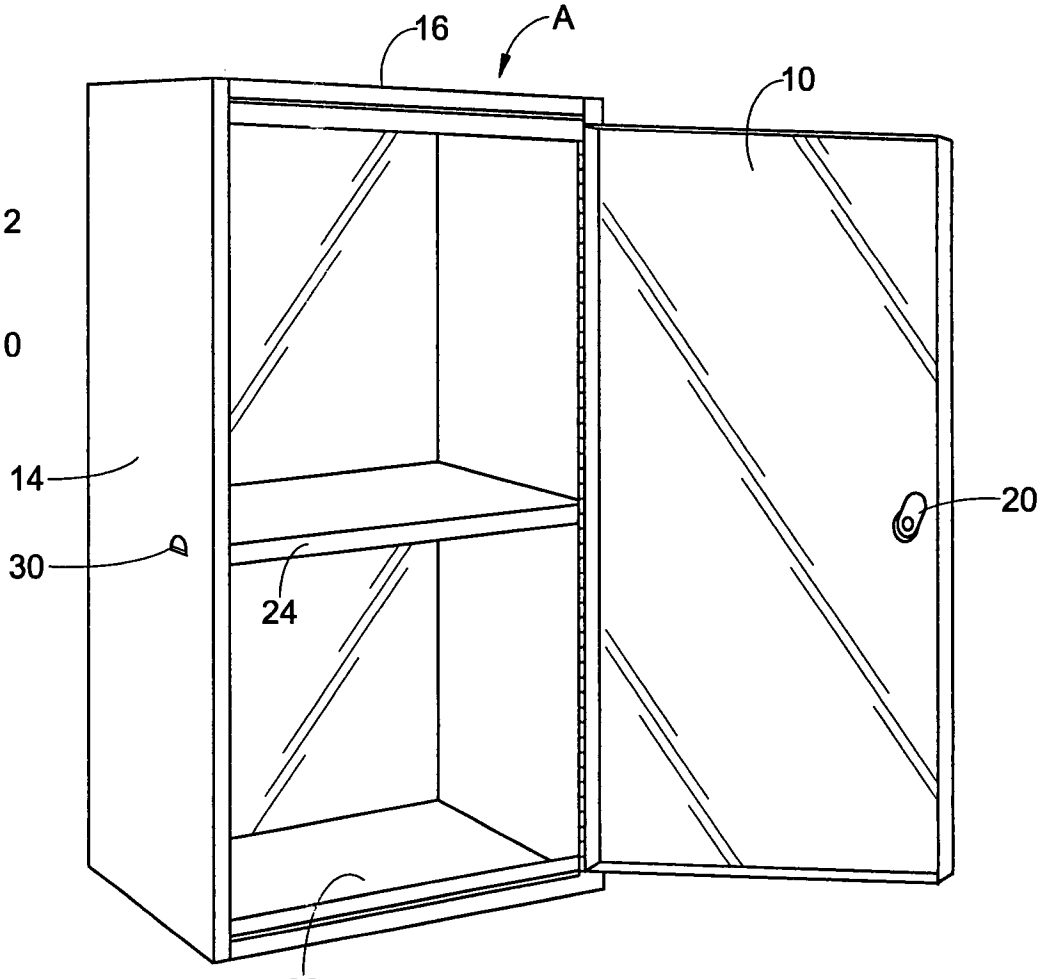
FIGS. 1-3 show a metal cabinet in open and closed configurations.

Referring now to FIG. 2, the cabinet has a bottom wall 22 and a shelf 24 which extends between side walls 12 and 14. The shelf is removably mounted to the side walls and is approximately parallel to the top and bottom walls. FIG. 2 only shows one shelf; however, a plurality of shelves may be mounted within the cabinet. Preferably, the shelves would be substantially parallel to each other.

Figure 3:
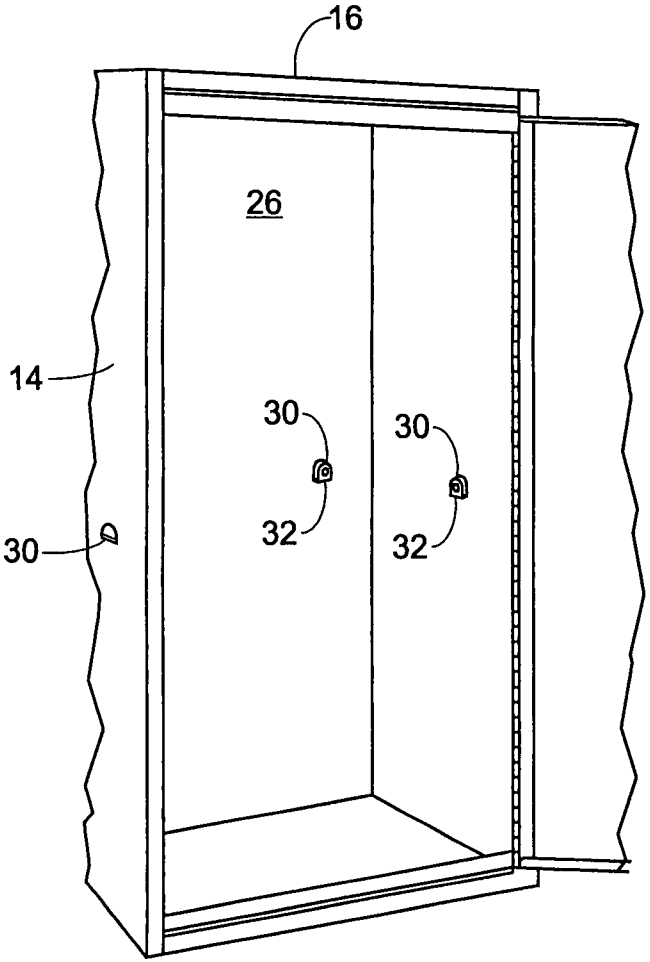

FIG. 3 illustrates a cabinet with shelves removed. Lances 32 are punched out or otherwise formed in the side walls of the cabinet to receive a portion of a shelf. Two lances are illustrated in the figure; however, a plurality of lances may be used to mount a plurality of shelves to the side walls. A rear wall 26 of the cabinet may also include one or more lances 32.

Figure 4:
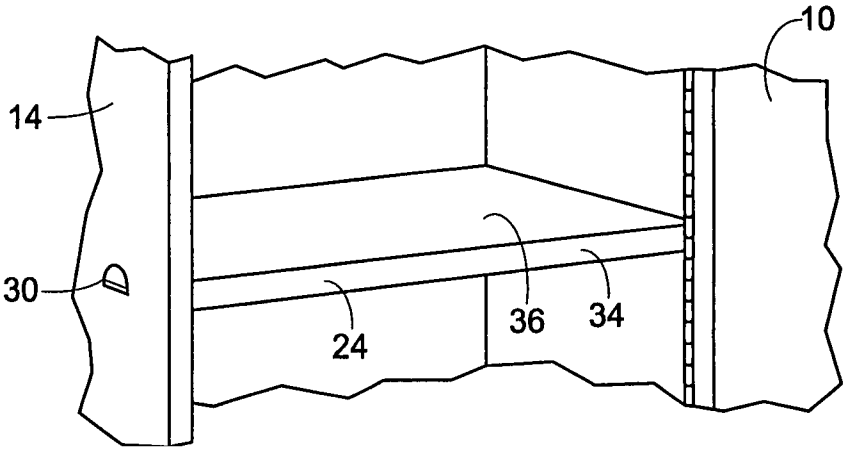
FIG. 4 is a close-up view of a shelf of the metal cabinet of FIGS. 1-3.

Referring now to FIG. 4, shelf 24 is mounted to side walls 12, 14 of the cabinet. The shelf has flanges 34 depending from a planar top surface 36 which are selectively received by the lances 32.

Figure 5:
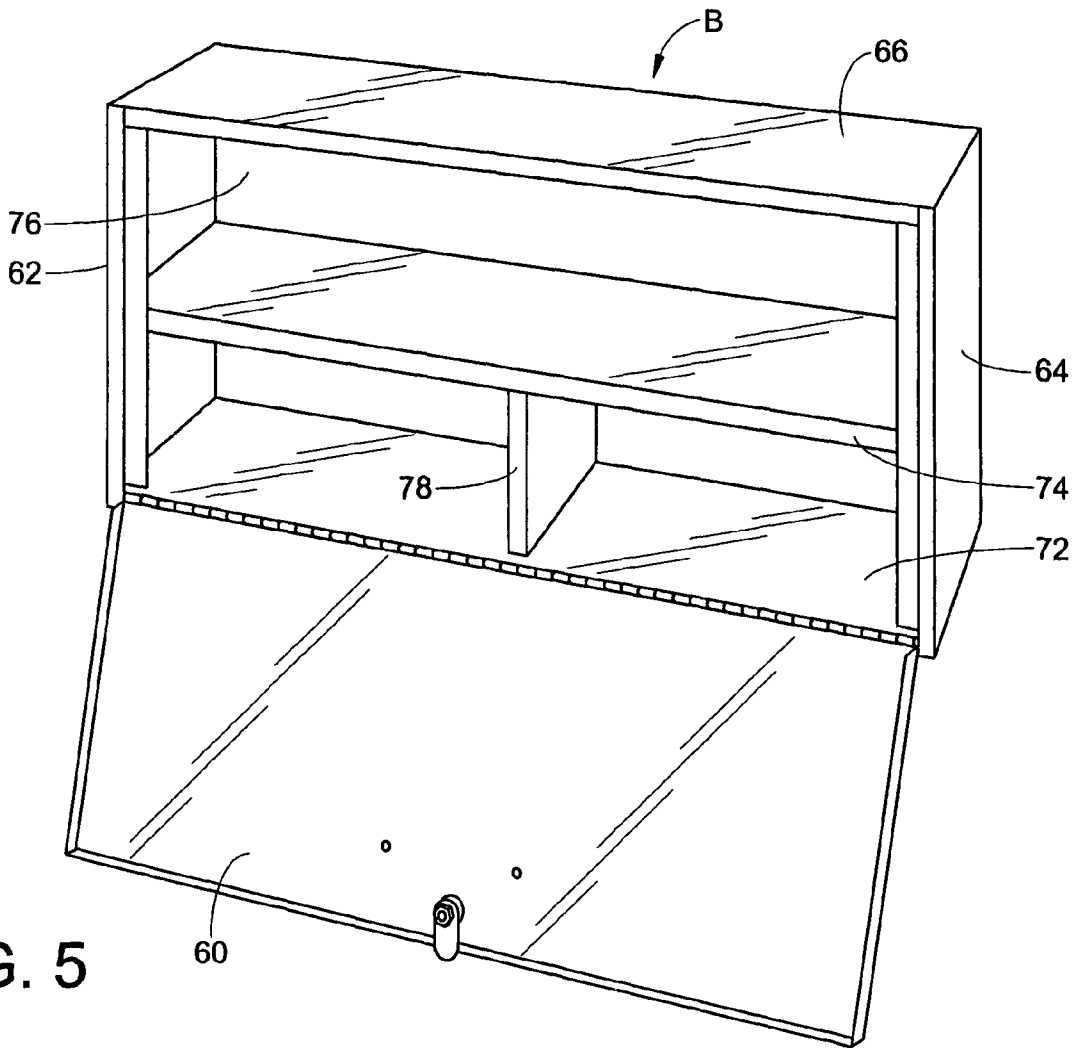
FIG. 5 is a perspective view of an alternative embodiment of a metal cabinet.

FIG. 5 illustrates a second embodiment of a metal cabinet B having a door 60, side walls 62 and 64, top wall 66, rear wall 76, and bottom wall 72. A shelf 74 is mounted inside the cabinet and extends between side walls 62 and 64. Preferably, shelf 74 is oriented parallel to the top and bottom walls. Furthermore, support wall 78 can be positioned between the center of the bottom wall 72 and the shelf 74 to support the shelf. Support wall 78 can also be connected to bottom wall 72 and the shelf 74 using the lances.

Figure 6:
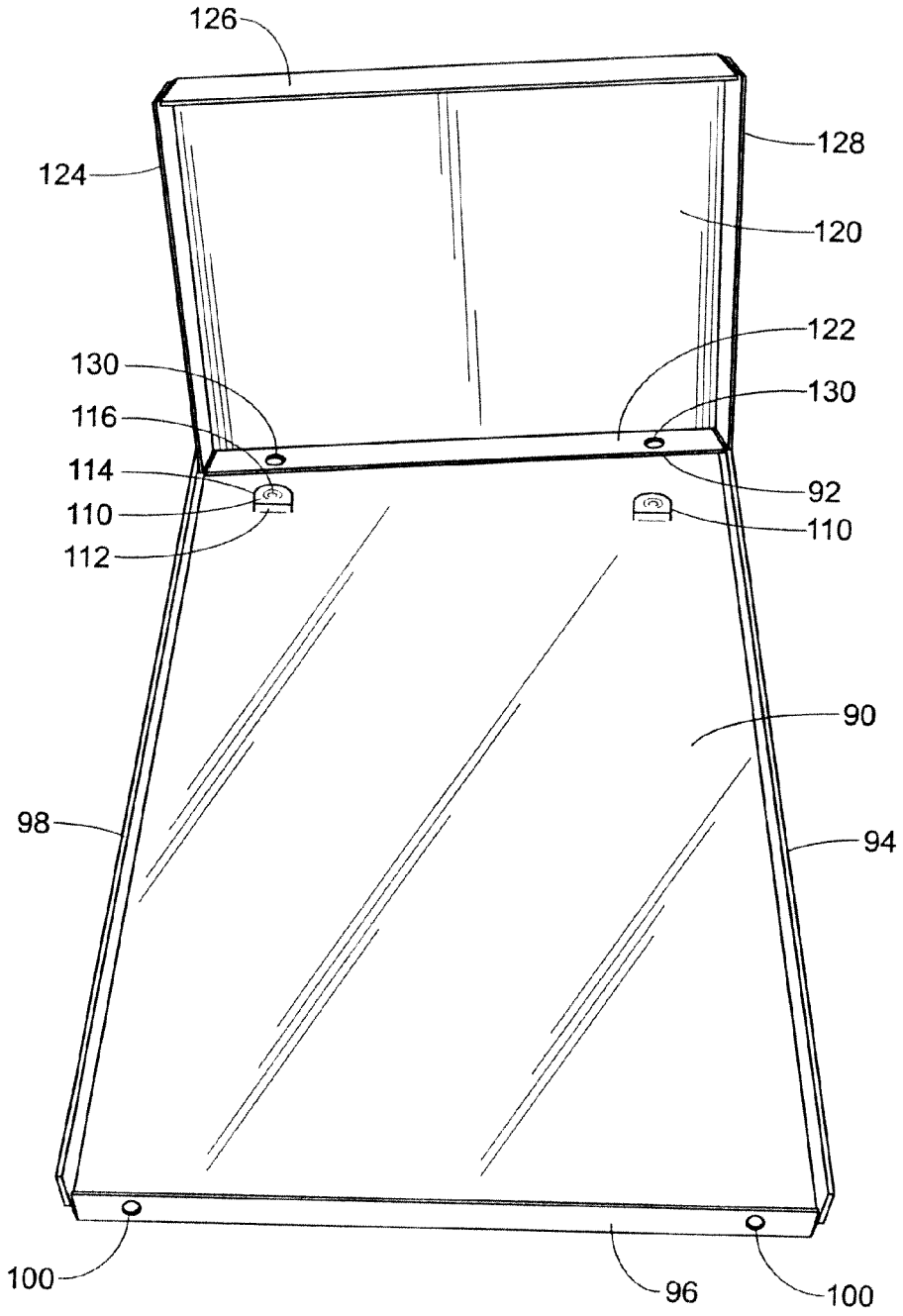
FIGS. 6-7 are perspective views of a cabinet side wall and a shelf.
Figure 11:
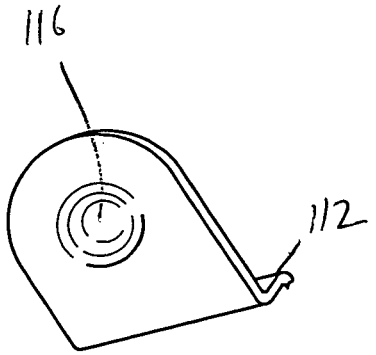
FIG. 11 is a perspective view of a lance not attached to a cabinet wall.
Figure 12:
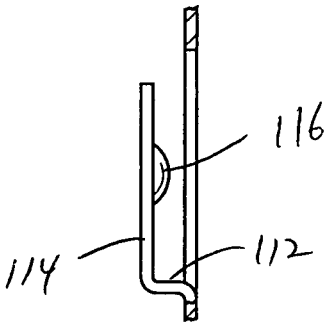
FIG. 12 is a side elevation view of the lance of FIG. 11.
Figure 13:
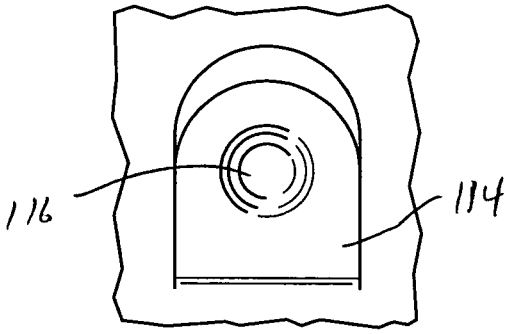
FIG. 13 is a front view of the lance of FIG. 11.

FIG. 6 shows a metal sheet 90 which can be used as a side wall of a metal cabinet. The sheet 90 contains flanges 92, 94, 96, and 98 that extend in a substantially perpendicular fashion to the sheet. The flanges each have a plurality of openings 100. Furthermore, sheet 90 has lances 110 formed across the surface of the sheet. The lances are spaced apart and are parallel to each other. With reference now to FIGS. 11-13 along with FIG. 6, each lance includes a first leg 112 that extends from and is substantially perpendicular to the sheet and a second leg 114 spaced from the sheet which also extends from and is substantially perpendicular to the first leg and parallel to the sheet.

The lance also includes a protrusion or dimple 116 formed on the second leg 114. Dimple 116 is depressed or punched in the second leg 114 and preferably has a substantially hemispherical shape or configuration. The dimple can also be a solid piece that is affixed to the leg 114, or the lance could be a unitary structure formed with a solid dimple. Also, leg 116 is shown having an accurate top edge; however, the leg can take any shape, including having a straight top edge or the like. It should be recognized that other forms or shapes of a dimple can also be used without departing from the scope of the invention. Sheet 90 can include a plurality of lances to receive a plurality of shelves, or other members to be mounted to a cabinet wall.

A second metal sheet 120 that can be used as a cabinet shelf mounts onto and is secured to sheet 90 via lances 110. Sheet 120 has flanges 122, 124, 126, and 128 that depend substantially perpendicular from edges of the sheet 120. The flanges each include a plurality of openings 130 that are each sized to receive a dimple 116 of the lance 110 when the sheet or shelf 120 is mounted to the sheet or side wall 90.

To mount the shelf 120 to the side wall 90, flange 122 is positioned adjacent or abutted against side wall 90 and flanges 122 and 128 are placed adjacent inside walls of flanges 98 and 94, respectively. Openings 130 are aligned with the lances 110. Flange 122 is slid into lance 110 permitting dimple 116 to slide along or ride over a portion of flange 122 and be received by opening 130. Dimple 116 provides a slight friction fit between flange 122 and lance 110. Thus, when the shelf is installed to the side wall, the shelf is prevented from being easily removed from the side wall. The shelf is not permanently affixed to the side wall; however, the dimple provides enough frictional resistance to require a small amount of force to release or pull the shelf from the side wall, thus securing the shelf in position.

Figure 7:
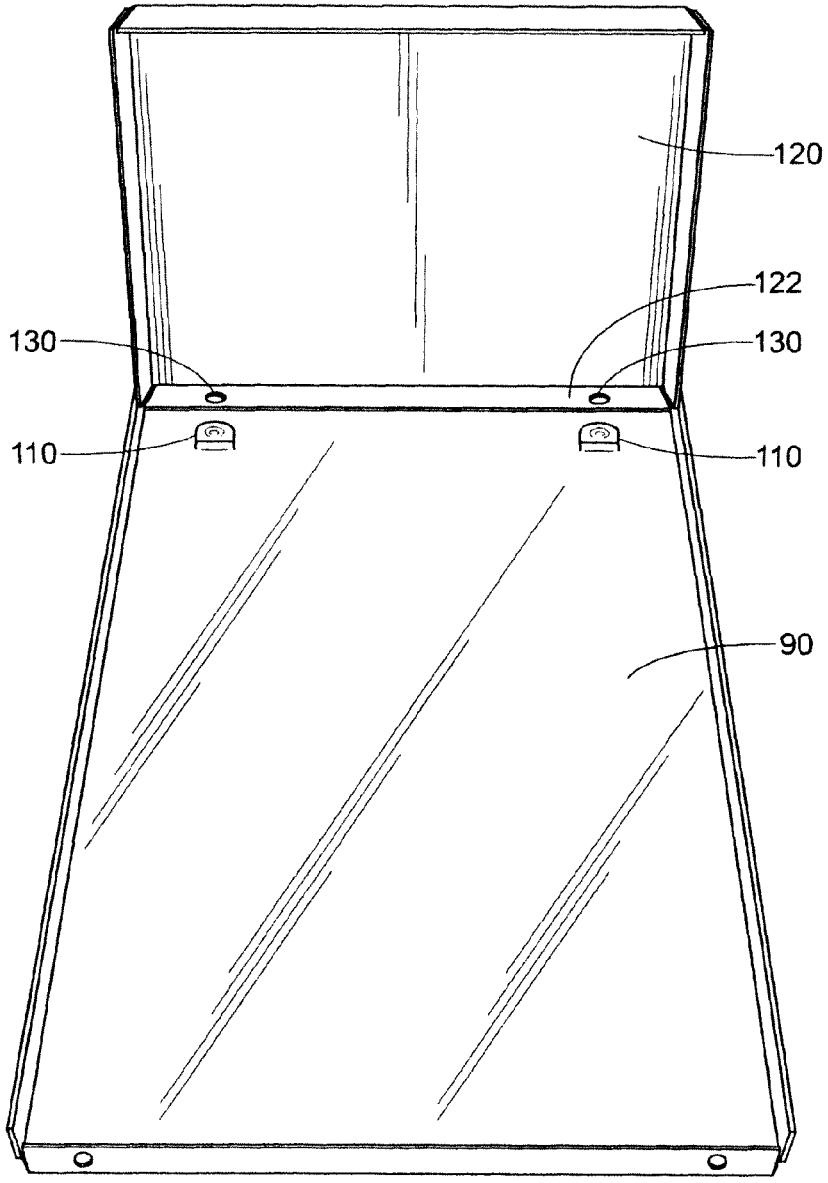

FIG. 7 illustrates shelf 120 just prior to flange 122 being slid and received by lance 110 of side wall 90.

Figure 8:
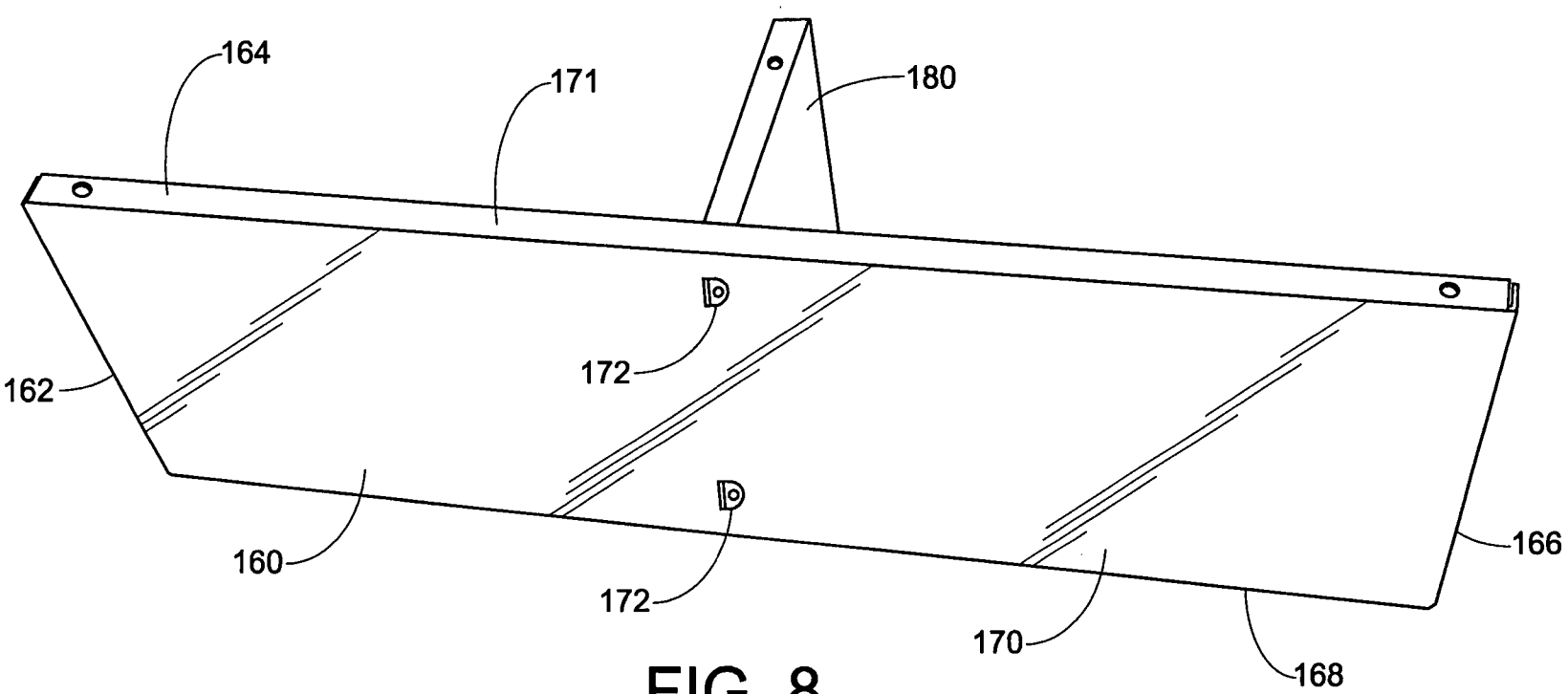
FIGS. 8-9 are perspective views of a second embodiment of a cabinet side wall and shelf.

Referring now to FIG. 8, a sheet 160, preferably made of metal, which can be used as a side wall of the cabinet includes flanges 162, 164, 166, and 168 extending from edges of the sheet. The flanges depend from and are substantially perpendicular to the sheet or side wall 160. The side wall 160 has a first surface 170 defining openings 172 that are formed when lances 200 are formed or punched through first surface 170 and second surface 171.

Figure 9:
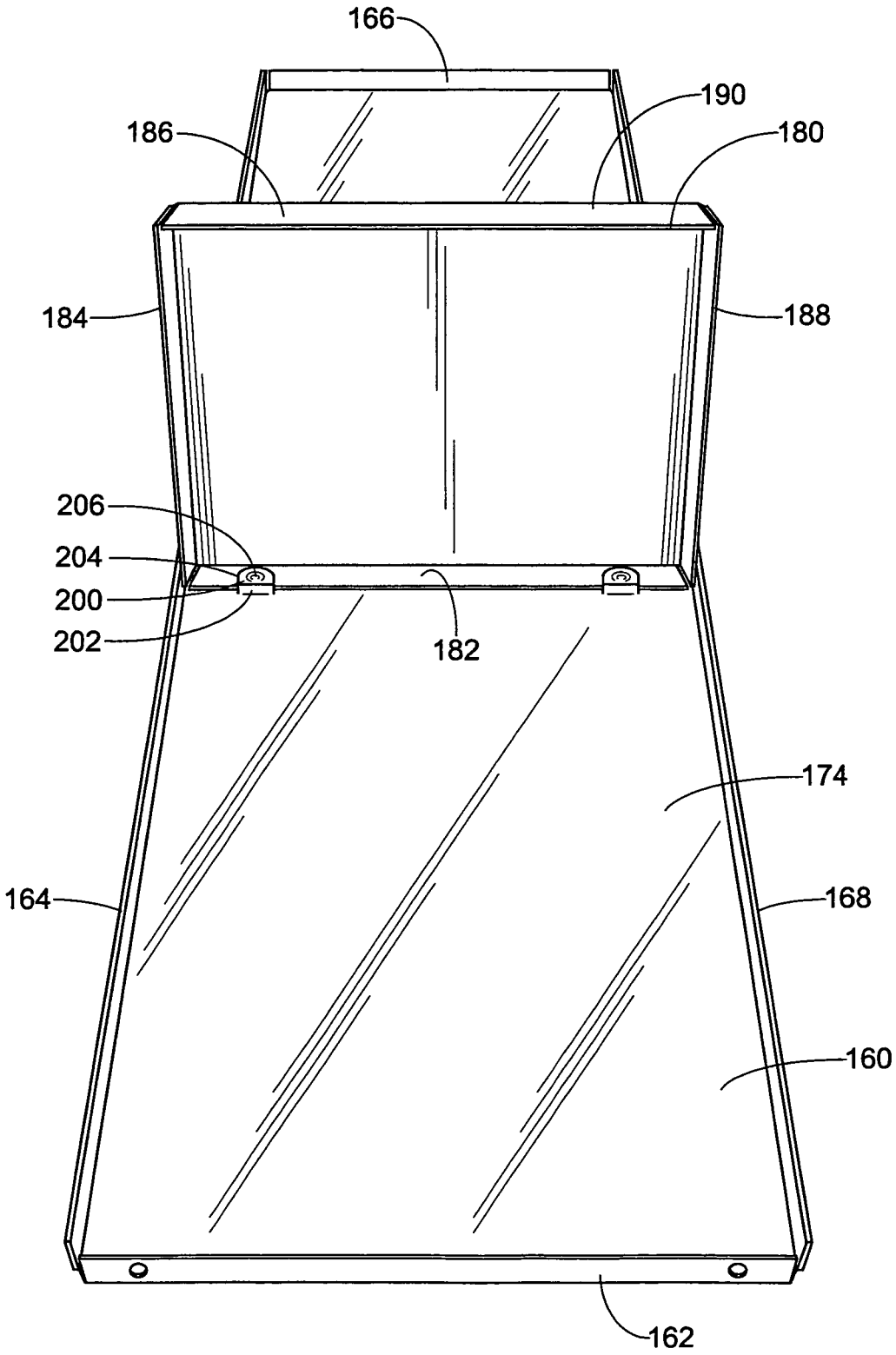

Referring now to FIG. 9, a sheet 180, preferably made of metal, used as a shelf is mounted to side wall 160 via engagement with lances 200. The shelf includes flanges 182, 184, 186, and 188 which extend from the edges of the wall 160. Each of the lances 200 includes a first leg 202 perpendicular to the side wall 160 and a second leg 204 spaced from the side wall which extends from and is perpendicular to the first leg and substantially parallel to the side wall. Each of the lances has a dimple 206 which protrudes from the second leg 204 towards an inner surface 174 of side wall 160. Preferably, dimple 206 has a hemispherical shape. However, other shapes and forms of a dimple may be used without departing from the scope of the invention.

Flanges 182, 184, 186 and 188 of the shelf 180 each have openings 190 sized to receive dimples 206 of the lances 200 when the shelf 180 is mounted to side wall 160. Shelf 180 is mounted to side wall 160, by abutting flange 182 to inner surface 174 of the side wall 160 and aligning openings 190 above the dimples 206 of the lances 200. With the openings 190 aligned with dimples 206, flanges 184 and 188 of shelf 180 are also aligned with side wall flanges 164 and 168. Flange 182 is slid down towards lances 200 so that dimples 206 slide along or ride over a portion of the flange 182 protruding through openings 190.

Figure 10:
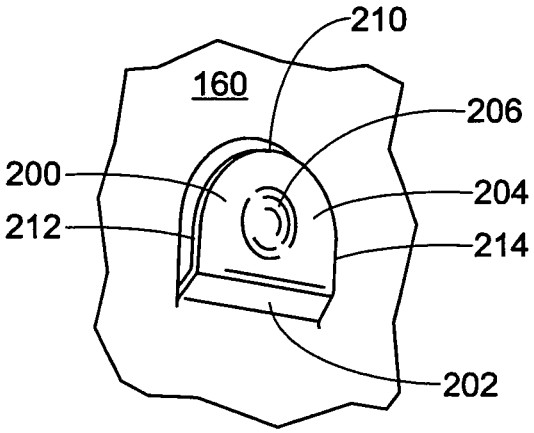
FIG. 10 is an enlarged view of a lance having a dimple therein.

Referring now to FIG. 10, the lance 200 may be formed by punching through the side wall 160 with a die to form a rounded upper portion 210 having two lateral linear portions 212, 214. The lance is then formed or punched to form first and second legs 202, 204. Dimple 206 is formed in substantially the center of leg 204. The dimple can also be formed off center on leg 204. Opening 190 is formed by punching the lance out of the wall.

The lance 200 may also be a separate member attached to side wall 160 by either welding or other fastening means. The lance would have substantially the same configuration as described in the preceding paragraphs; however, no opening 190 would be formed in the side wall 160.

The invention has been described with reference to several preferred embodiments. It should be apparent that modifications and alterations would occur to others upon a reading and understanding of the preceding specification. For example, the shape and configuration of the lance may be different in that it may not have a rounded upper portion or the sides may not be linear. As earlier stated, this specification is intended to disclose all such obvious modifications.

The invention claimed is:

1. A metal cabinet comprising:

a first side wall having flanges extending from opposite edges thereof; wherein at least one of said flanges comprises a pair of circular openings formed therein; wherein said openings are positioned near opposite ends of said at least one of said flanges;

wherein said first side wall comprises a central wall from which said flanges extend, a first support member punched out of and extending from said central wall adiacent an end of said central wall opposite an end of said central wall adiacent said at least one of said flanges which comprises said circular openings, such that a first opening is formed through said central wall adjacent the first support member, wherein the first support member includes a straight first leg extending perpendicular to the central wall and a straight second leg extending perpendicular from the first leg spaced from and substantially parallel to the central wall, the second leg includes first and second linear portions and a rounded portion extending between said first and second linear portions and a hemispherical dimple with rounded edges punched in a straight portion of the second leg, wherein said dimple extends toward said first opening;

a second side wall positioned opposite the first side wall; said second side wall has flanges extending from a central wall thereof; wherein at least one of said flanges comprises a pair of circular openings formed therein;

a third rear wall interconnecting the first and second side walls;

a base wall interconnecting the first, second and third walls;

a door hingedly connected to one of said first and second side walls and said base wall;

a second support member punched out of and extending from said central wall of said second side wall such that a second opening is formed through said central wall of said second side wall adjacent the second support member, the second support member of said second wall is positioned at substantially the same height from the base wall as the first support member on the first wall, the second support member includes a straight first leg extending perpendicular to the third wall and a straight second leg extending perpendicular from the first leg spaced from and at least substantially parallel to the third wall, the second leg of the second support member includes first and second linear portions extending perpendicular to said first leg and a rounded portion extending between said first and second portion and a hemispherical dimple with rounded edges formed in a straight portion of the second leg, wherein said dimple extends toward said second opening;

a third support member punched out of and extending from the third rear wall such that a third opening is formed through the third wall adjacent the third support member, the third support member includes astraight first leg extending perpendicular to the third wall and a straight second leg extending perpendicular from the first leg spaced from and substantially parallel to the third wall, the second straight leg of the third support member includes first and second linear portions and a rounded portion extending between the first and second portion and a hemispherical dimple having rounded edges extending towards an inner surface of the third side wall;

a removable shelf including a planar surface and a first flange depending from one end of the planar surface and a second flange depending from an opposite end of the planar surface; a third flange depending from a third end of the planar surface and a fourth flange depending from a fourth end of the planar surface opposite the third flange; wherein at least one of said flanges of said shelf comprises a pair of circular openings formed completely within a wall of said flange wherein one of said dimples of one of said first, second and third support members extends into one of said pair of circular openings of said shelf; and a support wall disposed between the first side wall and the second side wall wherein said support wall is parallel to said first side wall and said second side wall and is perpendicular to said base wall;

wherein said support wall is centrally positioned within the cabinet between said base wall and an underside of said removable shelf; wherein the support wall supports said shelf.

2. The cabinet of claim 1, wherein the first, second and third support members each have a rounded upper edge.

3. The cabinet of claim 1, wherein each of said first, second and third members is a lance.

4. The cabinet of claim 1, wherein said cabinet is fabricated from metal.

* * * * *